US005092595A

United States Patent [19]

Daravina

[11] Patent Number: 5,092,595

[45] Date of Patent: Mar. 3, 1992

[54] SOCCER GAME APPARATUS

[76] Inventor: Demostenes Daravina, 319 N. 64th St., Philadelphia, Pa. 19139

[21] Appl. No.: 657,402

[22] Filed: Feb. 19, 1991

[51] Int. Cl.[5] ..... A63F 7/06

[52] U.S. Cl. ..... 273/85 R; 273/118 A; 273/119 A; 273/128 A

[58] Field of Search ..... 273/85 R, 85 F, 129 K, 273/456, 108-126 A, 128 R-128 A

[56] References Cited

U.S. PATENT DOCUMENTS

| | | | |
|---|---|---|---|
| 1,648,956 | 11/1927 | Meade | 273/119 A |
| 2,631,854 | 3/1953 | Volman | 273/119 A X |
| 2,894,747 | 7/1959 | Seymour | 273/118 A |
| 3,090,622 | 5/1963 | Sire | 273/118 A X |
| 3,214,171 | 10/1965 | Luchsinger | 273/85 F |
| 3,522,945 | 8/1970 | Wagner | 273/85 F X |
| 3,834,707 | 9/1974 | Birkett | 273/126 A |
| 4,094,506 | 6/1978 | Morrison et al. | 273/85 R |
| 4,256,307 | 3/1981 | Brooks | 273/118 A |
| 4,274,635 | 6/1981 | Pakogian | 273/85 R |
| 4,382,600 | 5/1983 | Vieira | 273/118 R |

FOREIGN PATENT DOCUMENTS

| | | | |
|---|---|---|---|
| 2333073 | 1/1975 | Fed. Rep. of Germany | 273/85 R |
| 309217 | 8/1955 | France | 273/85 R |
| 2488141 | 2/1985 | France | 273/85 F |
| 150166 | 9/1920 | United Kingdom | 273/85 R |

*Primary Examiner*—Edward M. Coven
*Assistant Examiner*—Sebastiano Passaniti
*Attorney, Agent, or Firm*—Leon Gilden

[57] ABSTRACT

A soccer game including a support board mounting a simulated soccer playing field thereon includes goal housing mounted at each end of the playing field and support rods positioned adjacent the playing field at each end thereof, with each support rod mounting a plurality of tally spheres for maintaining scoring of the game during playing thereof. Stick members are utilized to direct a playing sphere throughout the playing field to effect scoring.

1 Claim, 5 Drawing Sheets

PRIOR ART

SOCCER GAME APPARATUS

BACKGROUND OF THE INVENTION

1. Field of the Invention

The field of invention relates to game apparatus, and more particularly pertains to a new and improved soccer game apparatus wherein the same is arranged for simulating a soccer game upon an associated playing field.

2. Description of the Prior Art

Soccer game simulation apparatus has been set forth in the prior art for simulating of soccer type conditions. For example U.S. Pat. No. 4,274,635 to Pakogian sets forth a soccer type game utilizing a rolling sphere, with various instructions positioned on the game board to permit unimpeded and restricted travel of a sphere propelled by one player towards an opponents goal.

U.S. Pat. No. 4,257,599 to Cutri sets forth a further example of a soccer game played upon a board utilizing sticks to propel a missile towards an opposing goal.

U.S. Pat. No. 4,350,343 to Salazar, U.S. Pat. No. 4,119,314 to Moena, and U.S. Pat. No. 4,025,073 to Furr, et al. set forth soccer type game simulation apparatus utilizing a playing board.

As such, it may be appreciated that there continues to be a need for a new and improved soccer game apparatus as set forth by the instant invention which addresses both the problems of ease of use as well as effectiveness in construction providing enhanced ease of use and providing a simulated soccer game and further utilizing optionally positioned magnetic members to provide further impediment to a projectile sphere utilized in play of the game.

SUMMARY OF THE INVENTION

In view of the foregoing disadvantages inherent in the known types of soccer game apparatus now present in the prior art, the present invention provides a soccer game apparatus wherein the same utilizes a playing board mounting impediments such as posts and magnets in communication with the playing field to enhance difficulty in directing a projectile towards an opposing goal. As such, the general purpose of the present invention, which will be described subsequently in greater detail, is to provide a new and improved soccer game apparatus which has all the advantages of the prior art soccer game apparatus and none of the disadvantages.

To attain this, the present invention provides a soccer game including a support board mounting a simulated soccer playing field thereon including a goal housing mounted at each end of the playing field and support rods positioned adjacent the playing field at each end thereof, with each support rod mounting a plurality of tally spheres for maintaining scoring of the game during playing thereof. Stick members are utilized to direct a playing sphere throughout the playing field to effect scoring.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved soccer game apparatus which has all the advantages of the prior art soccer game apparatus and none of the disadvantages.

It is another object of the present invention to provide a new and improved soccer game apparatus which may be easily and efficiently manufactured and marketed.

It is a further object of the present invention to provide a new and improved soccer game apparatus which is of a durable and reliable construction.

An even further object of the present invention is to provide a new and improved soccer game apparatus which is susceptible of a low cost of manufacture with regard to both materials and labor, and which accordingly is then susceptible of low prices of sale to the consuming public, thereby making such soccer game apparatus economically available to the buying public.

Still yet another object of the present invention is to provide a new and improved soccer game apparatus which provides in the apparatuses and methods of the prior art some of the advantages thereof, while simultaneously overcoming some of the disadvantages normally associated therewith.

Still another object of the present invention is to provide a new and improved soccer game apparatus wherein the same utilizes a plurality of impediments and a plurality of categories of impediments to enhance difficulty in effecting a goal scoring during play of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of the playing board utilized by opponents in play of the game.

DESCRIPTION OF THE PREFERRED EMBODIMENT

Figure 1:
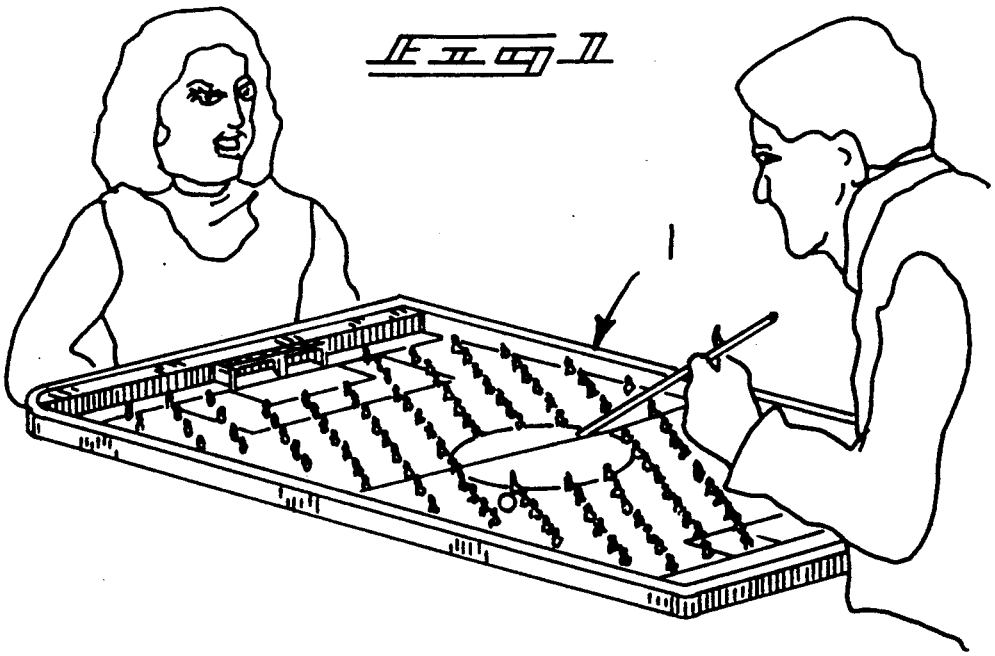
FIG. 1 is an isometric illustration of a prior art soccer game type apparatus.

With reference now to the drawings, and in particular to FIGS. 1 to 10 thereof, a new and improved soccer game apparatus embodying the principles and concepts of the present invention and generally designated by the reference numeral 10 will be described.

FIG. 1 illustrates a prior art soccer game apparatus 1 utilizing a playing board mounting impediment post thereon and a playing sphere, as set forth in U.S. Pat. No. 4,274,635.

Figure 2:
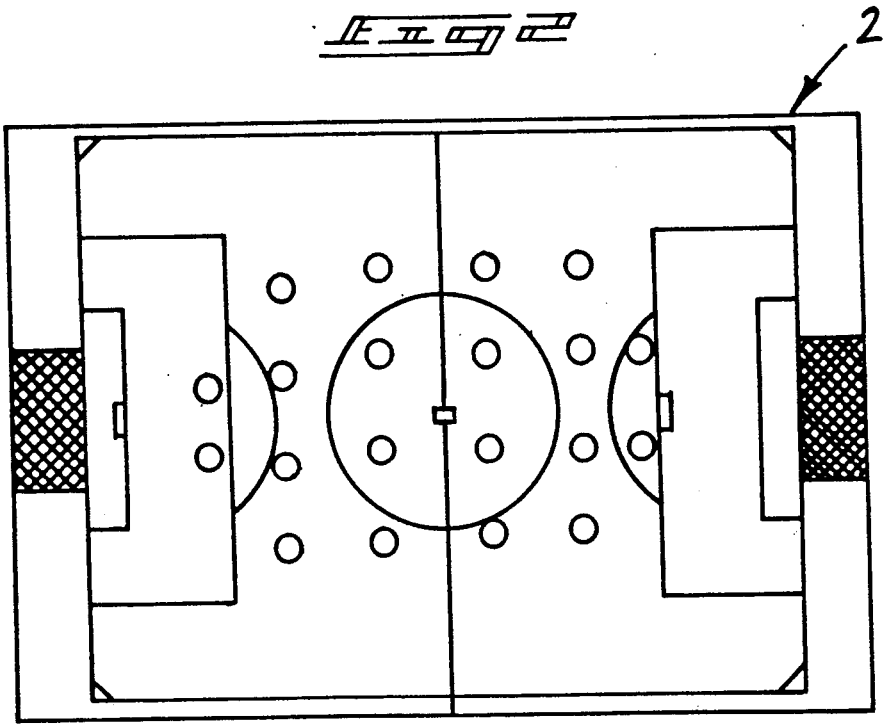
FIG. 2 is an orthographic top view of a further example of a soccer game apparatus utilized in the prior art.
Figure 3:
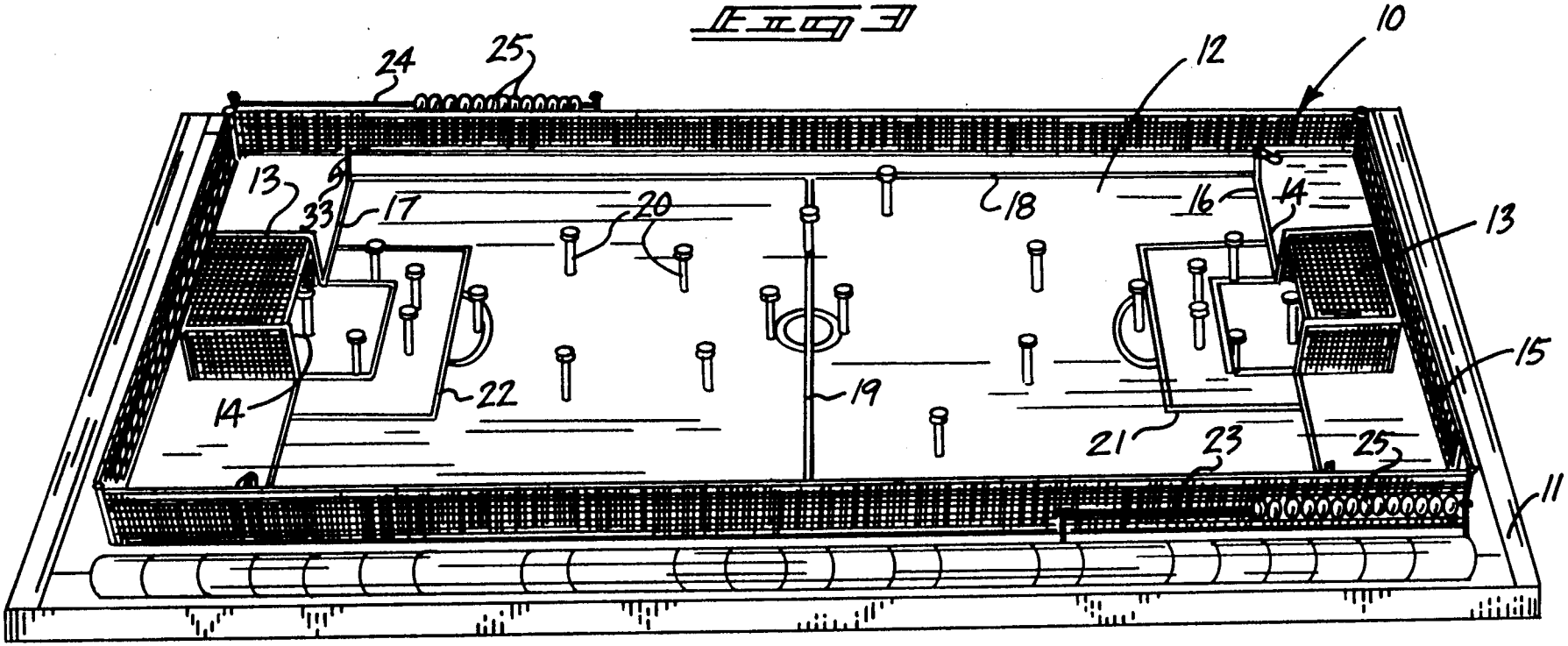
FIG. 3 is an isometric illustration of the playing board utilized by the instant invention.
Figure 3:
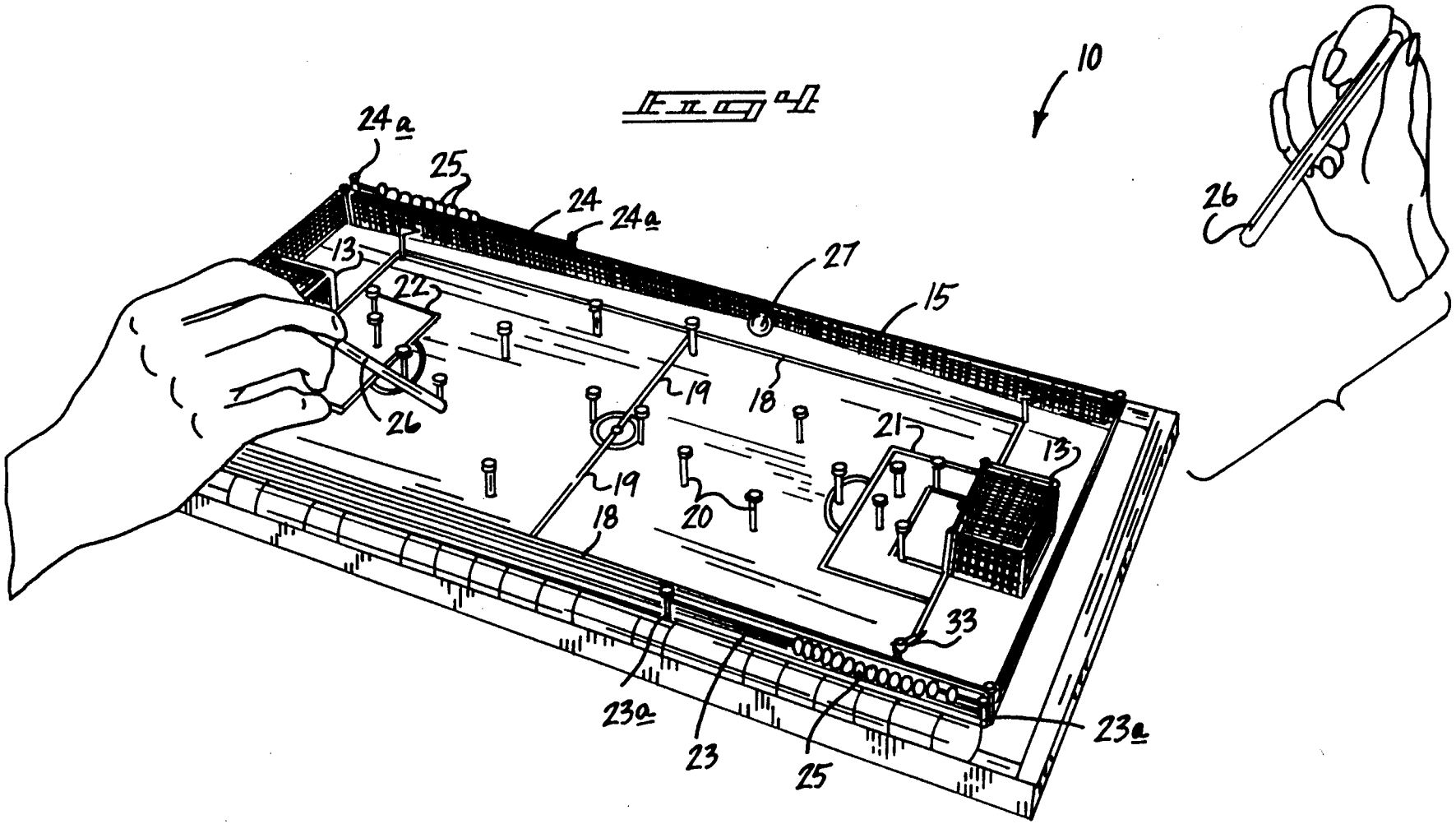
Figure 5:
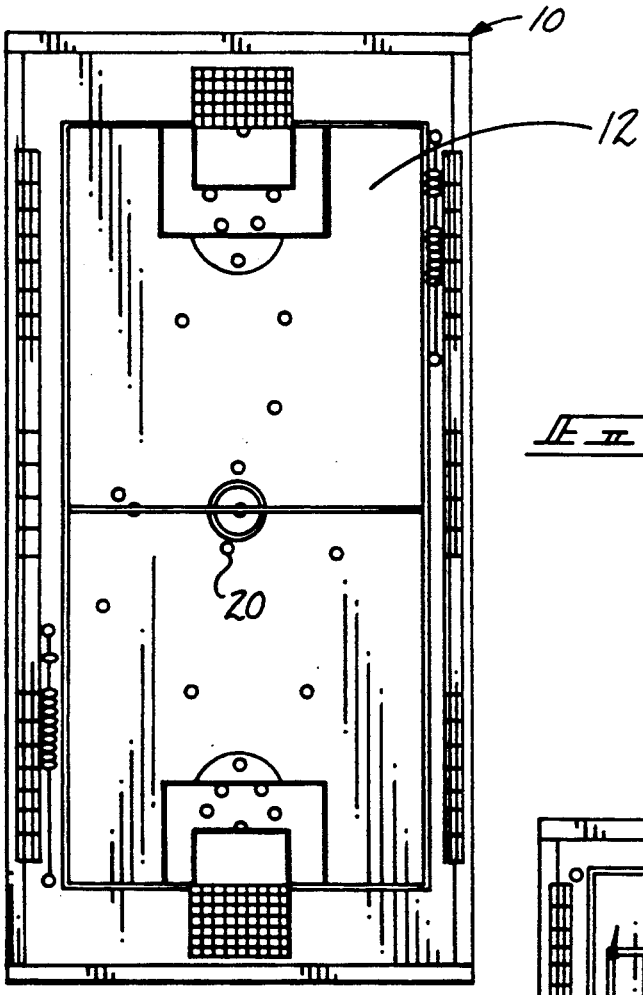
FIG. 5 is an orthographic top view of the playing board.

U.S. Pat. No. 4,257,599 sets forth a further prior art soccer game type apparatus 2, as illustrated in FIG. 2, utilizing disc type sliders in play of the game.

More specifically, the soccer game apparatus 10 of the instant invention essentially comprises a planar support base 11 defined by a playing field 12 top surface formed of a ferro magnetic material. A playing field includes opposed goal members 13 defined by mesh housing enclosures formed with a forward open end 14, wherein the open ends 14 are aligned and in confronting relationship relative to one another. A perimeter wall member 15 is mounted in surrounding relationship relative to the playing field 12 orthogonally and fixedly mounted thereto. First and second respective end lines 16 and 17 are in parallel relationship defining opposed ends of a field of play of the organization, with side lines 18 orthogonally mounted to opposed ends of the end lines 16 and 17. The goal members 13 are medially positioned of each respective end line 16 and 17, with each open end 14 aligned with each respective end line. A mid field line medially bisects the playing field. Further, flag members 33 are orthogonally mounted at intersections of each side line with each respective end line for enhanced visibility of positioning the playing sphere (see FIG. 4 and FIG. 7 for example) during certain penalty shots.

Figure 6:
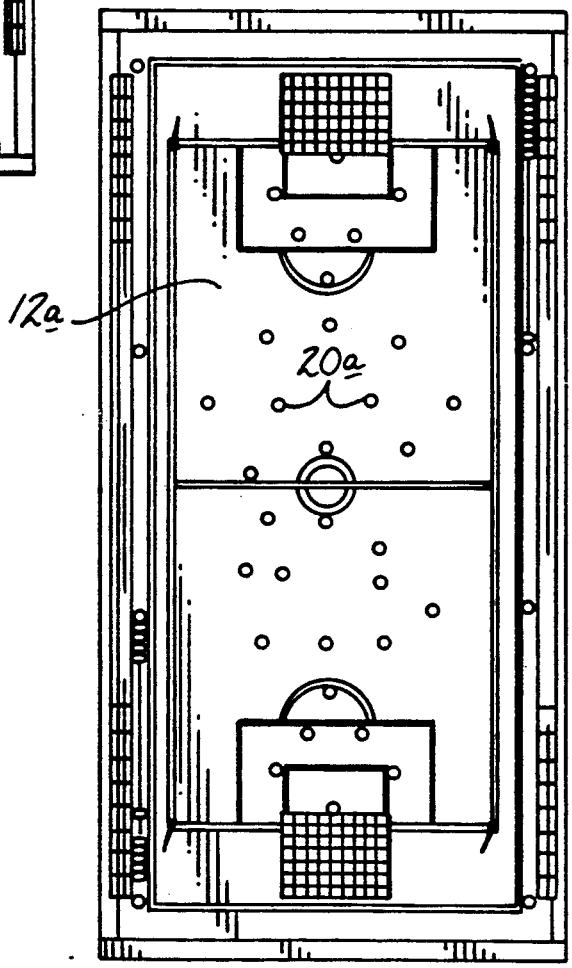
FIG. 6 is an orthographic top view of a modified playing board utilizing a plurality of peg receiving bores to effect selective positioning of pegs throughout the playing field.
Figure 7:
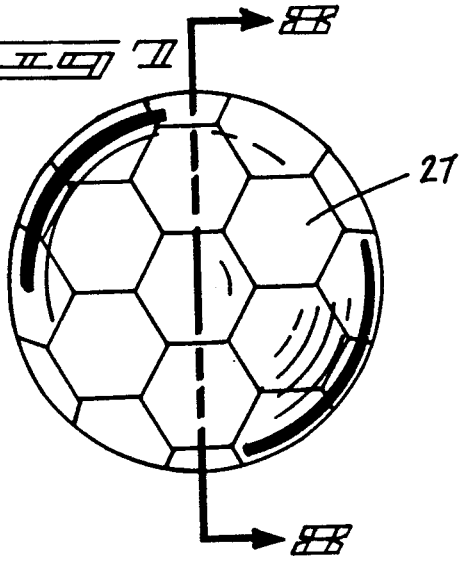
FIG. 7 is an orthographic side view of the playing sphere utilized by the instant invention.
Figure 8:
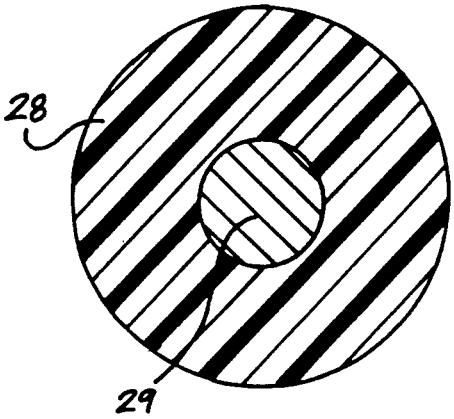
FIG. 8 is an orthographic view, taken along the lines 8—8 of FIG. 7 in the direction indicated by the arrows.
Figure 9:
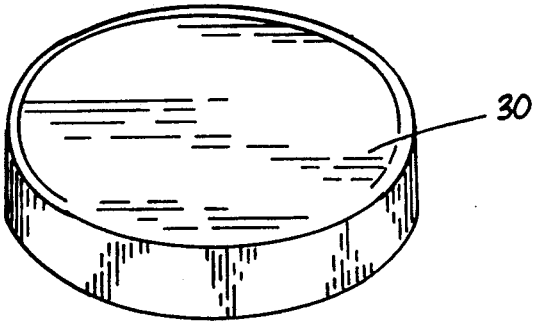
FIG. 9 is an isometric illustration of a magnet member utilized by the instant invention.
Figure 10:
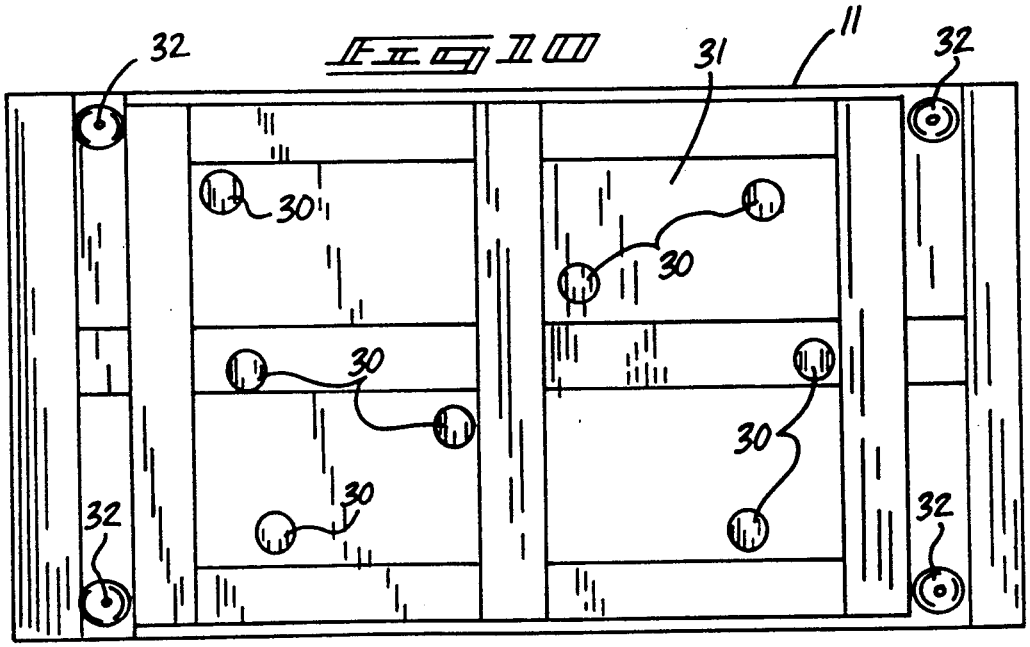
FIG. 10 is an orthographic bottom view of the playing board mounting a plurality of magnet members thereon.

Post members 20 are positioned throughout the playing field, with an equal number of post members 20 positioned on the field of play on each side of the mid field line 19 between the side and end lines. The post members 20 are receivable within bores 20*a*. FIG. 6 illustrates a plurality of bores 20*a* defined by a greater number than that of associated posts 20 to permit selective pattern forming of a predetermined number of posts in bores formed on each side of the playing field relative to the mid field line 19.

A first support rod 23 and a second support rod 24 are fixedly mounted on the support base 11 exteriorly of the wall member 15 supported upon associated first and second respective rod posts 23*a* and 24*a*. Each of the support rods 23 and 24 slidably mount a plurality of spherical point tally members 25 thereon to permit ease of scorekeeping during play of the game. Stick members 26 are utilized to propel a game sphere 27 towards an opponents goal member through the forward opened end 14 attempting to circumvent and avoid the post members 20 in attempting to project the sphere 27 into an opponents goal member 13.

The game sphere 27 is optionally formed with a polymeric shell 28 housing a ferro magnet 29 medially thereof. The bottom surface 31 of the planar support base 11 mounts a plurality of magnetic cylinders 30 in a random positioning about the bottom surface of the playing field 12. In this manner, the game sphere 27 directed over a magnetic cylinder 30 effects a veering or course displacement of the sphere to provide a further impediment on the playing field. The bottom surface of the support base 11 includes support legs 32 formed of a second predetermined height greater than a first predetermined height defined by each of the magnetic cylinders 30 to project the support legs 30 below the magnetic cylinders to permit ease of positioning of the magnetic cylinders on the bottom surface of the playing field 12.

Play of the game utilized conventional soccer rules. It should be noted that during certain penalty situations, such as a player impacting the game sphere a plurality of times during its projection towards an opponents goal, a penalty shot is effected. Further, if the game sphere is struck to effect its removal from the field of play over the wall 15, a penalty is effected. A player striking the ball a plurality of times in a single turn further effects a penalty shot. When a penalty shot is required, the game sphere is positioned upon an associated first or second "U" shaped goal penalty line 21 that medially intersects a respective first and second end line 16 and 17 to permit a player a penalty shot into an opponent's goal member 13. It may be desired that ten goals or such arbitrary number decide and determine a winner, whereupon after half of the predetermined number of goals are effected, the players rotate the table but agree to utilize an opposing portion of the playing field. Game sphere 27 leaving the field of play 12 over a side line 18 or end line 16 or 17 effects positioning of the game sphere where it is imparted across the playing field.

It should be noted that various rules and regulations may be decided upon in utilizing the apparatus of the instant invention to enhance enjoyment and use of the organization by appointed players.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soccer game apparatus comprising, in combination, a planar support base, the support base including a base top surface and a base bottom surface, the support base including a playing field aligned medially of the support base, and the playing field including a perimeter wall member fixedly and orthogonally mounted to the support base top surface in alignment with an outer perimeter of the playing field, and a plurality of post members wherein the post members are defined by a further predetermined number, wherein the predetermined number is greater than the further predetermined number to permit repositioning of post members in various patterns about the field of play, and a game sphere positioned within the playing field, and a plurality of stick members for propelling the game sphere towards a goal member, and including a respective first and second support rod positioned adjacent opposed respective ends of the support base adjacent the wall member exteriorly thereof, wherein each respective support rods slidably mounts a plurality of spherical point tally members to permit visual tally of scores effected by opposing players, and wherein the playing field is formed of a ferromagnetic material, and the game sphere includes a polymeric shell with a ferromagnet positioned medially of the polymeric shell, and further including a plurality of magnetic cylinders selectively positionable about the planar support base bottom surface, and including a plurality of support legs mounted to the bottom surface, wherein the support legs are defined by a second predetermined height and the magnetic cylinders are defined by a first predetermined height, wherein the second predetermined height is greater than the first predetermined height.

* * * * *